US005511676A

United States Patent [19]

Holmes

[11] Patent Number: 5,511,676

[45] Date of Patent: Apr. 30, 1996

[54] COUPLER YOKE WITH TAPERING KEY SLOT REINFORCEMENT

[75] Inventor: Ralph V. Holmes, Nova Scotia, Canada

[73] Assignee: Maritime Steel And Foundries Limited, New Glasgow, Canada

[21] Appl. No.: 343,891

[22] Filed: Nov. 16, 1994

[30] Foreign Application Priority Data

Dec. 17, 1993 [CA] Canada ..... 2111804

[51] Int. Cl.[6] ..... B61G 9/22

[52] U.S. Cl. ..... 213/67 R; 213/67 A; 213/69

[58] Field of Search ..... 213/67 R, 67 A, 213/68, 69, 70

[56] References Cited

U.S. PATENT DOCUMENTS

| | | | |
|---|---|---|---|
| 1,352,151 | 9/1920 | Simonson | 213/67 R |
| 1,636,690 | 7/1927 | Hawkes et al. | 213/67 A |
| 1,951,318 | 3/1934 | Barrows | 213/67 A |
| 4,635,804 | 1/1987 | Hanula | 213/67 R |
| 5,096,076 | 3/1992 | Elliott et al. | 213/67 A |
| 5,221,015 | 6/1993 | Mautino et al. | 213/67 R |
| 5,320,229 | 6/1994 | Mautino et al. | 213/67 A |
| 5,339,970 | 8/1994 | Mautino et al. . | |

OTHER PUBLICATIONS

"Mechanics of Materials"; Beer et al; McGraw–Hill Inc.; pp. 382–383.

"Finite Element Structural Analysis"; Yang; Prentice–Hall Inc.; pp. 176–181.

*Primary Examiner*—Robert J. Oberleitner
*Assistant Examiner*—S. Joseph Morano
*Attorney, Agent, or Firm*—Sughrue, Mion, Zinn, Macpeak & Seas

[57] ABSTRACT

A coupler yoke for a coupler of a railway vehicle is constructed with a nose portion which is reinforced by a raised region which surrounds the forward end of the key slot. A tapered buttress extends along the length of both sides of the key slot. The width and depth of the buttress increase from minima at the rearward end of the key slot, and merge with the raised region reinforcing the nose of the yoke.

3 Claims, 5 Drawing Sheets prior art

COUPLER YOKE WITH TAPERING KEY SLOT REINFORCEMENT

FIELD OF THE INVENTION

The present invention relates to a yoke for a coupler for a railway vehicle and, more particularly, to a yoke having a reinforced nose portion to strengthen and improve the service life of the yoke by reducing or avoiding deformations in the vicinity of the key slot of the yoke.

SUMMARY OF THE PRIOR ART

Couplers used to connect together two railway vehicles are typically joined to the vehicles by way of respective coupler yokes. A standard coupler yoke is typically a unitary casting with a symmetrical configuration about longitudinal planes of symmetry. The yoke comprises a rear portion forming a draft gear seat, top and bottom straps extending forwardly of the rear portion, and a head portion disposed at the forward end of the top and bottom straps. The head portion comprises top and bottom walls which form an extension of the top and bottom straps, and two key slot walls having respective key slots formed therein. The key slots are designed to receive therethrough a draft key through which pulling forces are transmitted to the yoke. The region surrounded by the walls of the yoke head portion, the rear draft gear seat, and the top and bottom straps form the draft gear pocket in which draft gear of the coupling can be operatively installed to cushion the tensile and compressive forces occurring in train service.

With the trend towards higher capacity and heavier rail cars, the expected service life of a conventional yoke can be very limited. Deformation in the forward portion of the key slot can become so severe that the yoke must be replaced. The type of deformation which has been commonly found to occur is believed to be caused by loading of the key slot reinforcing ribs located along the key slot walls and used to form a connection with the horizontal key and with the shank portion of the coupler. As a railway car is subject to varying track conditions, factors such as rocking and super elevations cause the mating couplers to angle with respect to the car, thereby applying torsional loads to the coupler draft assembly as well as tensile and compressive forces. Torsional loads produce a twisting angle between the interconnected components of the coupler, which will generally angle freely until clearances prohibit further motion.

Normally, a coupler can impose a rotational movement on the draft key while it is restrained in the yoke key slot. Upon continued turning movement after metal to metal contact between the draft key and walls of the key slot in the yoke, the coupler will rotate the yoke until interference occurs between the follower block and parts of the yoke. When such torsional angling is compounded with vertical angling (for example, due to uneven track conditions), the draft key can bind on the sides of the key slots, creating point loads and associated concentrated stresses.

Under draft service conditions, the highest loads are typically localized in the vicinity of the key slot, particularly in the nose portion of the key slot walls immediately forward of the key slot. The level of stress in the key slot walls gradually reduces from a maximum at the forward end of the key slot to a minimum at the rear of the key slot, at least partially as a result of the reinforcing effects of the top and bottom walls of the head portion.

In conventional yokes a raised rib is provided around each of the key slots, in order to reduce stresses and consequent distortion of the key slot walls during service. In addition, a raised rib extending forwardly from each key slot to the front of the nose portion is typically provided to further reinforce the region immediately forward of each key slot.

U.S. Pat. No. 5,096,076 (Elliott et al.) teaches an alternative means of reinforcing the nose portion of the key slot walls of the yoke head portion. In the yoke disclosed by Elliott et al., the conventional raised rib extending forwardly from each key slot to the front of the nose portion is extended to form a semicircular raised portion which substantially surrounds the forward end of each key slot. The outer surface of the raised portion is convex, so that the cross sectional shape of the nose portion is generally trapezoidal with one convexly curved side.

However, since the raised nose portion extends only a short distance rearwardly of the nose portion, stresses (and associated material deformations) can become concentrated in the key slot reinforcing ribs to the rear of the raised nose portion.

SUMMARY OF THE INVENTION

It is an object of the present invention to provide a standard AAR type E coupler yoke having an improved service life.

It is another object of the invention to provide a yoke in which the amount of reinforcement provided along the length of each key slot wall varies according to the expected loading imposed on the key slot wall, so that stress concentrations within the key slot wall are reduced and loads imposed on the key slot wall are more uniformly distributed to the remainder of the yoke structure.

According to the present invention, there is provided a yoke for a railway draft gear, said yoke having a head portion comprising two opposed top and bottom walls, and two opposed spaced apart key slot walls disposed between said top and bottom walls, each of said key walls comprising a respective elongate key slot capable of operatively receiving therein a draft key of the railway draft gear, and a reinforcing portion surrounding a forward end of said key slot and extending rearwardly along the length thereof, said reinforcing portion having a cross-sectional area which is a maximum in the vicinity of the forward end of said key slot and which tapers to a minimum at a rearward end of said key slot.

The present invention provides an improved construction for the nose portion of a yoke whereby concentration of stresses (and associated deformations in the yoke key slot wall) are significantly reduced. By this means, the service life of the yoke can be increased.

BRIEF DESCRIPTION OF THE DRAWINGS

Features and advantages of the present invention will be more fully understood from the following detailed description, with reference to the appended drawings in which.

It will be noted that throughout the drawings and the following description, like features are identified by like reference numerals.

DETAILED DESCRIPTION OF A PREFERRED EMBODIMENT

In order to provide a better understanding of the present invention, a brief discussion of two prior art yokes is provided below, with reference to FIGS. 1*a* and 1*b*.

Figure 1A:
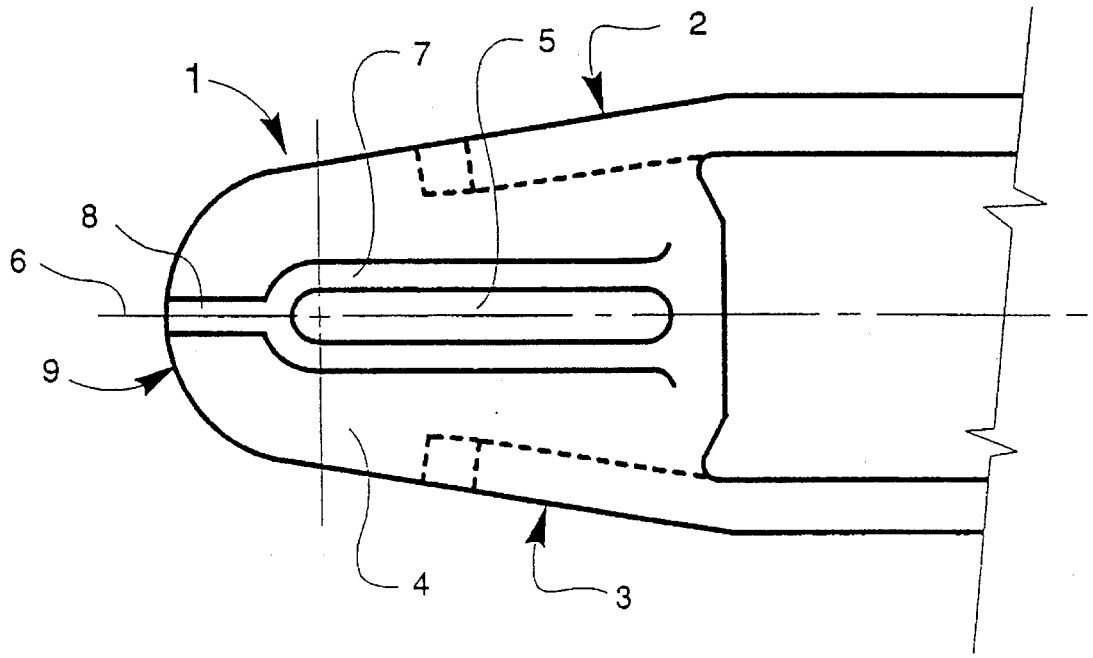
FIGS. 1*a* and 1*b* are side view of the head portion of two prior art yokes.

Referring to FIG. 1*a*, a head portion 1 of a yoke comprises top and bottom walls 2 and 3, and a pair of opposed key slot walls 4 (only one is shown). Each key slot wall 4 includes a respective key slot 5 aligned with a plane of symmetry 6 of the yoke. A key slot rib 7 extends around a forward end, and along the length of both sides, of the key slot 5, and defines inner walls of the key slot 5 against which a draft key (not shown) will bear during service. Finally, a nose rib 8 extends from the forward end of the key slot 5 to the nose 9 of the head portion 1.

Figure 1B:
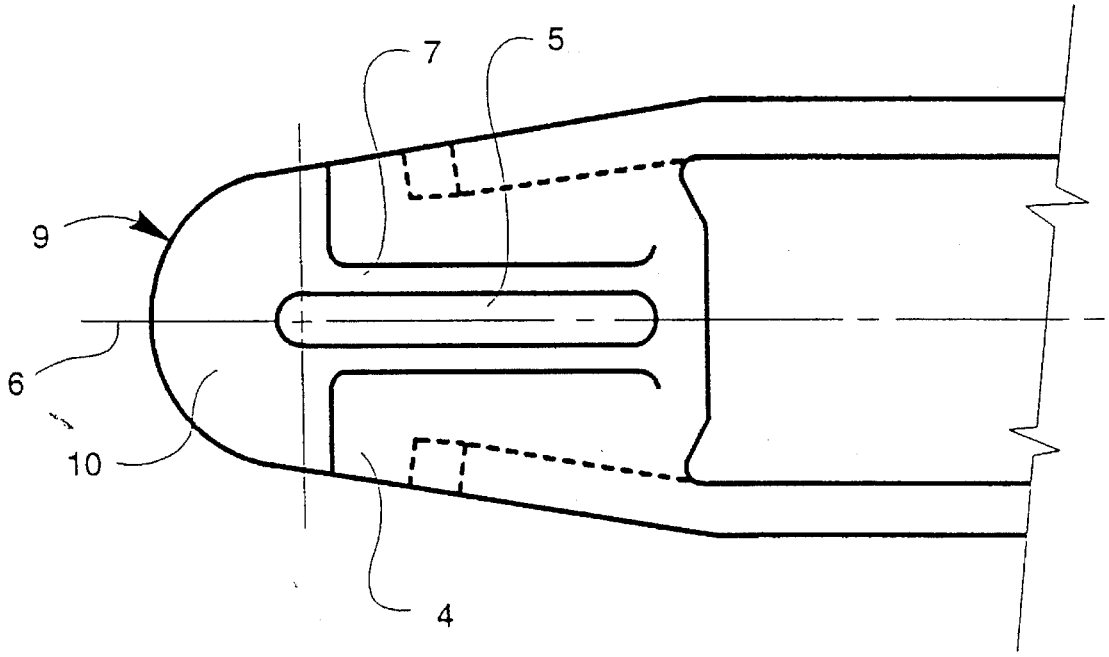
prior art FIGURE 1B

Referring now to FIG. 1*b*, there is shown a yoke constructed according to U.S. Pat. No. 5,096,076 (Elliott et al.). In this case, the nose 9 of the head portion 1 is reinforced by a raised portion 10 extending around the forward end of the key slot 5 between the key slot and the peripheral edge nose 9. The exterior surface of the raised portion 10 is convexly curved. The raised portion 10 tapers down to smoothly join the surface of the key slot wall 4 a short distance behind the forward end of the key slot 5. A key slot rib 7 extends along the length of both sides of the key slot 5, in much the same manner as in the prior art example described above and illustrated in FIG. 1*a*.

The yoke illustrated in FIG. 1*b* provides improved service life by increasing the amount of reinforcement around the nose 9 of the key slot walls 4, where the largest in-service loadings (and consequently highest material stresses and deformations) are normally expected to be encountered. However, the degree of reinforcement along most of the length of the sides of the key slots 5 is the same in both prior art yokes. As a result, both prior art yokes suffer from the disadvantage that localized loadings along the length of the key slot 5 (to the rear of the forward end thereof) can produce localized areas of high stress, particularly in the presence of material and/or manufacturing flaws in the yoke. Such localized stresses can cause material deformations and cracking, and reduce the service life of the yoke.

Referring now to FIGS. 2 to 5, an embodiment of a yoke according to the present invention will be described in detail. According to the present invention, the nose 9 of the head portion 1 is reinforced by a raised portion 11 extending around the forward end of the key slot 5 between the key slot and the peripheral edge of the nose 9. The exterior surface of the raised portion 11 is generally flat, as illustrated in the cross-sectional views shown in FIGS. 4 and 5. Both sides of the key slot 5 are reinforced by a buttress 12 which gradually increases in both width and depth from the rear-most end of the key slot 5, and joins with the raised portion 11 at the forward end of the key slot 5.

Figure 4:
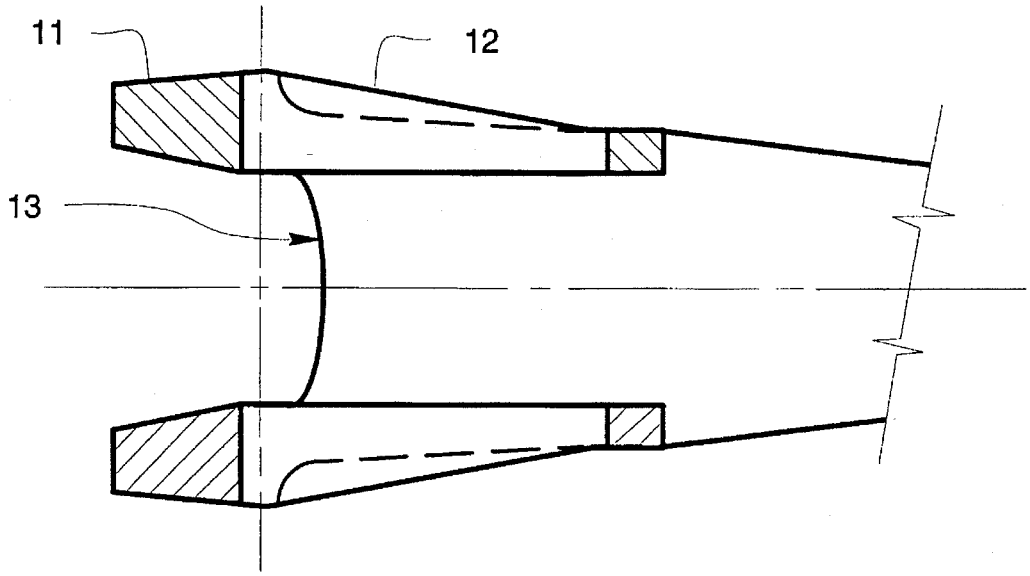
FIG. 4 is a cross-sectional view taken along line I—I of FIG. 3.
Figure 5:
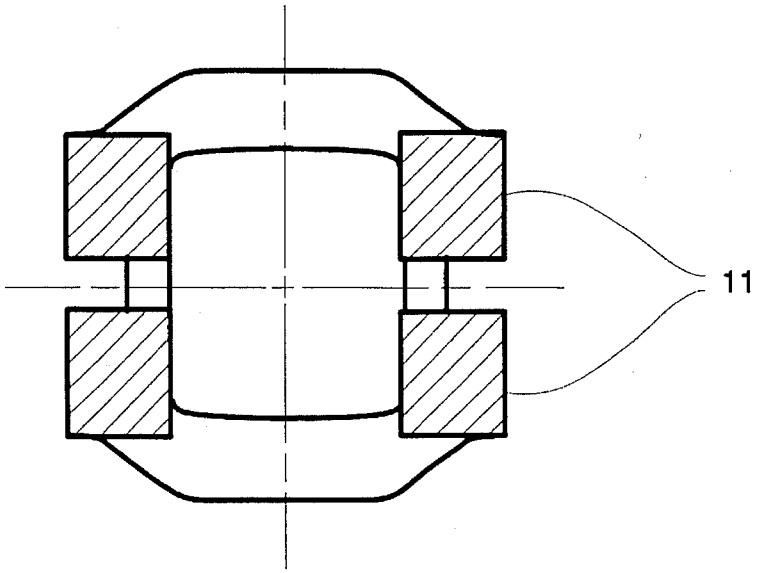
FIG. 5 is a cross-sectional view taken along line II—II of FIG. 3.

Referring to FIG. 4, the nose portion 9 has a generally trapezoidal cross-sectional shape in a longitudinal plane of symmetry of the yoke. This trapezoidal cross-section smoothly transitions to a substantially rectangular cross-section in a lateral plane coextensive with the centre axes of the forward end radii of the key slots 5, as shown in FIG. 5.

Figure 6:
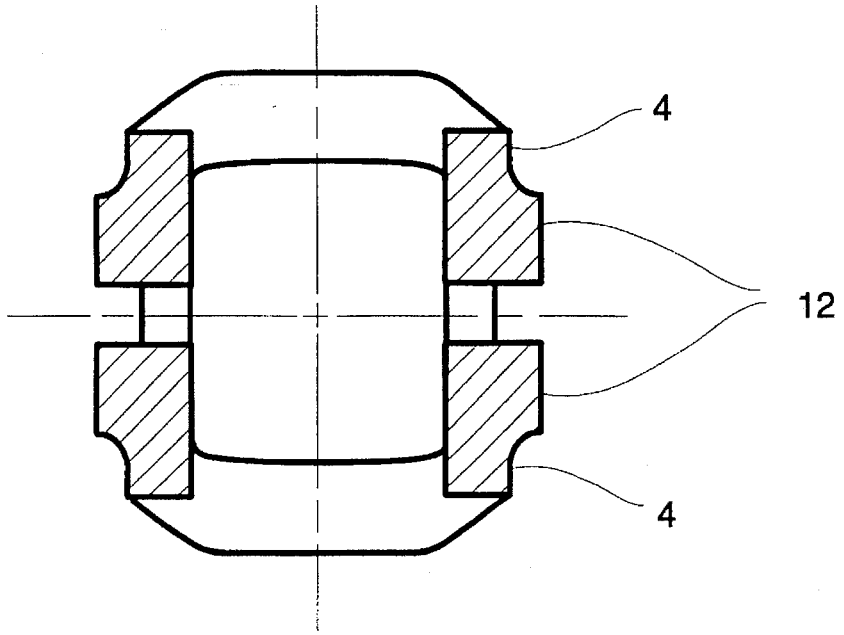
FIG. 6 is a cross-sectional view taken along line III—III of FIG. 3.

As seen in FIG. 6, to the rear of the forward end of the key slot 5, the buttresses 12 on either side of the key slots 5 retain the substantially flat outer surface of the raised portion 11, but diminish in width and depth towards the rear-most end of the key slot 5.

Figure 2:
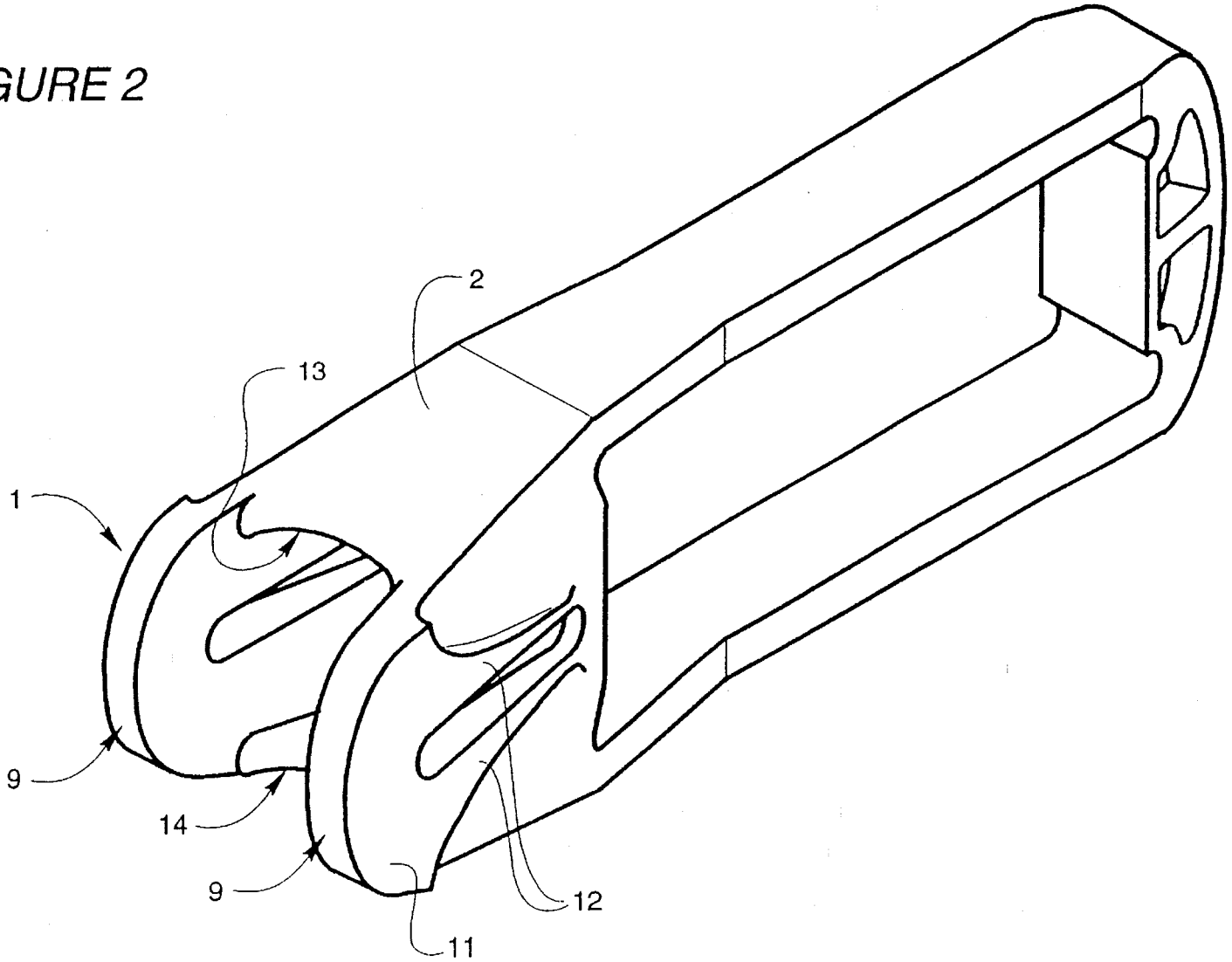
FIG. 2 is an isometric view of a yoke according to an embodiment of the present invention.
Figure 3:
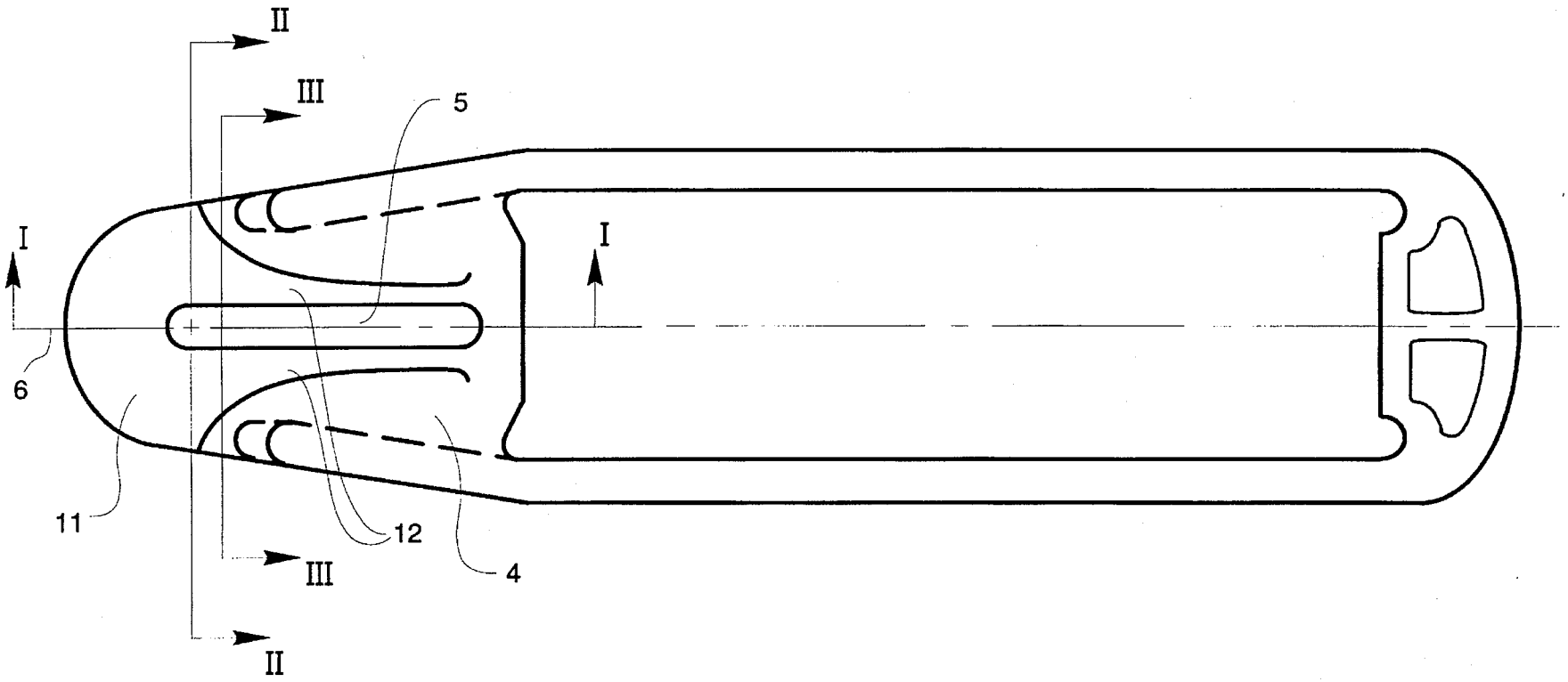
FIG. 3 is a side view of the yoke illustrated in FIG. 2.

In order to further improve stress flow, and avoid stress concentrations, the forward edges 13 and 14 of the top and bottom walls, 2 and 3 respectively, are curved in both the vertical and (substantially) horizontal planes, as shown particularly in FIGS. 2–4. This geometry contrasts with the substantially flat forward edge taught in the prior art (see FIGS. 1*a* and 1*b*).

I claim:

1. A yoke for a railway draft gear, said yoke having a head portion comprising two opposed top and bottom walls, and two opposed spaced apart key slot walls disposed between said top and bottom walls, each of said key slot walls comprising a respective elongate key slot capable of operatively receiving therein a draft key of the railway draft gear, and a reinforcing portion surrounding a forward end of said key slot and extending rearwardly along substantially the entire length thereof, said reinforcing portion comprising:

a thickened nose portion surrounding a forward end of said key slot; and a pair of buttress portions disposed on respective sides of said key slot and joining with said nose portion, each said buttress portion having a substantially rectangular cross-sectional area which is a maximum at the forward end of said key slot and which gradually diminishes in both width and depth toward the rearward end of said key slot.

2. A yoke as defined in claim 1 wherein said nose portion is provided with a substantially trapezoidal cross-section in a longitudinal plane of symmetry of said yoke, and a substantially rectangular cross-section in a lateral plane co-extensive with central axes of forward-most end radii of said key slots.

3. A yoke as defined in claim 1 wherein forward--most edges of said top and bottom walls are semicircular in cross-section.

* * * * *